United States Patent [19]

Eisman et al.

[11] Patent Number: 4,802,960

[45] Date of Patent: Feb. 7, 1989

[54] ELECTROCHEMICAL CELL AND PROCESS EMPLOYING A BIASING ELECTRODE

[75] Inventors: Glenn A. Eisman, Nassau Bay; Lloyd E. Alexander, Angleton, both of Tex.

[73] Assignee: The Dow Chemical Company, Midland, Mich.

[21] Appl. No.: 826,162

[22] Filed: Feb. 4, 1986

[51] Int. Cl.[4] ..... C25B 1/16; C25B 1/26

[52] U.S. Cl. ..... 204/98; 204/128; 204/DIG. 7

[58] Field of Search ..... 204/1 R, 98, 128, 282

[56] References Cited

U.S. PATENT DOCUMENTS

| | | | |
|---|---|---|---|
| 4,213,833 | 7/1980 | Lefevre | 204/128 |
| 4,306,952 | 12/1981 | Jansen | 204/128 |
| 4,312,720 | 1/1982 | Lefevre | 204/128 |
| 4,430,177 | 2/1984 | McIntyre et al. | 204/128 |

*Primary Examiner*—John F. Niebling

[57] ABSTRACT

In an electrolysis cell, a separator having a buried wire screen is disclosed. The screen is connected to a bias voltage source to repel unwanted ionic migration across the screen and hence the separator.

12 Claims, 1 Drawing Sheet

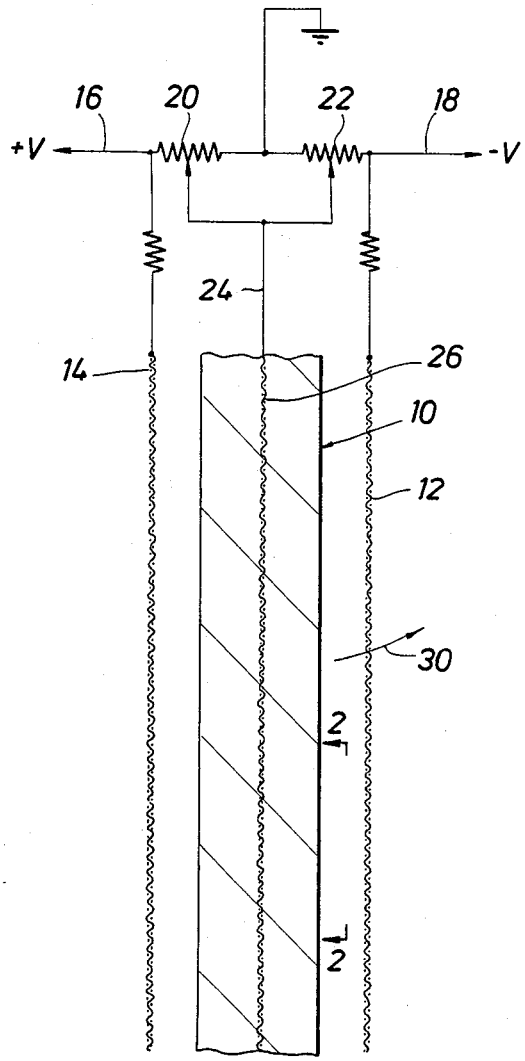
FIG. 1
FIG. 2
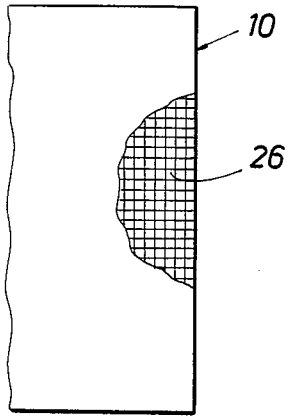
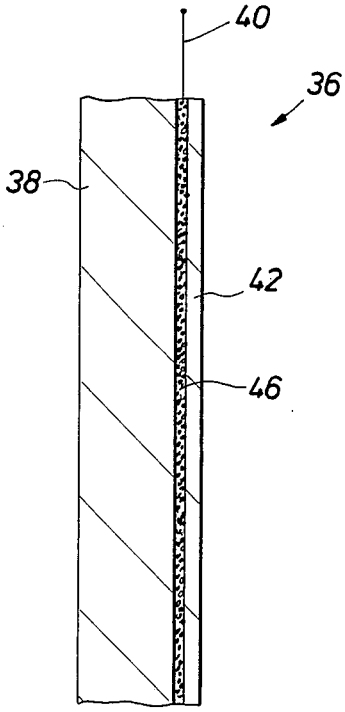
FIG. 3

ELECTROCHEMICAL CELL AND PROCESS EMPLOYING A BIASING ELECTRODE

BACKGROUND OF THE DISCLOSURE

A separator is the device dividing an electrolysis cell into two parts. The term "separator" thus includes a central membrane or diaphragm. In general terms, a separator is a sheet like member which divides the electrolysis cell into two compartments. One is labeled the anode compartment filled with the anolyte. Moreover, the other is the cathode compartment where the cathode is located. In such an arrangement, it is desirable that transport across the separator enables electrochemical conversion to occur. An electrolysis cell is ordinarily used to convert the feed into different compounds or to convert compounds into elements. This exchange is normally carried out by ionic movement across the separator. To this end, the separator must be able to transport ions across the separator from one side to the other. These reactions normally occur in the presence of water which must wet the separator to enable ionic movement.

A classic electrolysis conversion is in the chlor-alkali cell. NaCl and water is supplied to one side. The sodium ions are transported across the separator. This forms NaOH on the cathode side of the cell. Moreover, it liberates chlorine and hydrogen gas from the two electrodes in the cell. The process cannot occur except that ions and associated water move through the separator. In this example, the cathode liberates gaseous hydrogen. This changes the pH of the catholyte by forming $OH^-$ ions on the cathode side of the cell. They react the sodium ions with $OH^-$ to thereby form a strong caustic solution which is recovered as a valuable product.

A high concentration of $OH^-$ ions is observed in the catholyte. While they are formed on the cathode side and are typically discharged in the caustic solution, there remains the possibility that a small percent of the $OH^-$ ions will migrate back across the separator toward and into the anodic chamber. Thus, the separator is called upon to pass positive sodium ions from anode to cathode side while rejecting $OH^-$ ions attempting to migrate in the opposite direction. This is true even where the separator is in ion exchange resin. The hydroxyl back migration is highly undesirable. One showing of high concentration is the output of hypochlorite. This is undesirable. Thus, it is desirable that the separator transfer freely selected ions in the proper direction and forbid specific ion movement in the opposite direction. This enables a more pure product to be made, and it also improves cell efficiency.

It is possible to strengthen the separator by making it thicker or to otherwise impede ionic movement. When this is done, cell efficiency is ordinarily decreased. There are several patents of deNora and perhaps U.S. Pat. No. 4,381,979 is the most typical of the deNora references. As described in deNora, there is a membrane 105 immediately adjacent to a metal screen or mat 113. It assists in holding the screen in location against the separator. It is described in the disclosure as a compressible electroconductive wire mat. Moreover, it is said to have an open mesh knitted wire construction.

The present apparatus is useful with a separator arranged between a widely spaced pair of electrodes on opposite sides of the separator, or those which are immediately adjacent to the separator as in a cell having zero gap between the electrodes. It also operates well with a ion exchanqe resin. An example is a fluoropolymer layer having sulfonic or a sulfonic/carboxylic complex. The present apparatus cooperates also with a diaphragm which relies primarily on a tortious path for ionic movement restriction. The present apparatus contemplates the addition of an electrostatic repulsive charge electrode within the separator. The form is preferably an insulated screen wire embedded in the separator. An alternate form can be obtained by placing a layer of conductive materials in particulate form which is bonded by typical fluoropolymer or even electrically conducting polymer which is porous and placed on the cathode. In any case, the repulsive negative charge repels $OH^-$ ions and thereby enhances the tortuosity effect of the pathway through the membrane. An important aspect of the present invention is the advantage of producing stronger catholyte. That is, there is no loss of $OH^-$ ions across the separator and greater efficiency is thereby achieved in making a stronger caustic solution. Likewise, the strength of the anolyte is increased because it is not subject to degradation of the $OH^-$ ions migrating through the separator. In addition, the invention helps to reduce the concentration of hypochlorite ($ClO^-$) in the anolyte.

In summary, the present apparatus is thus described as a separator which is either a diaphragm or other ion exchange resin membrane having the added feature of a central coterminous layer. This layer in the preferred embodiment is formed of a fine wire woven into a screen covered with an insulated material. It is connected with a suitable voltage souroe so that it is oharged. It creates a repellent electric (biased negative) field which rejects $OH^-$ to prevent back migration. An alternate embodiment can be made by utilizing finely divided particulate conductor metals bonded with a suitable bonding agent whereby the layer functions to impose a static eleotric field repelling $OH^-$ ions. The repellent action is accomplished to thereby selectively prevent back migration of $OH^-$ ions.

DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a sectional view through a separator incorporating a wire screen creating a repellent electric field in accordance with the teachings of the present disclosure, the separator being positioned between an anode and cathode in an electrolysis cell;

FIG. 2 is a view taken along the line 2—2 of FIG. 1 showing details of construction of a wire screen member placed in the separator; and FIG. 3 is an alternate embodiment showing an alternate mode of construction of a charged layer in a separator.

DETAILED DESCRIPTION OF THE PREFERRED EMBODIMENT

Attention is first directed to FIG. 1 of the drawings. There, the numeral 10 generally identifies a separator adapted to be placed in an electrolysis cell. The cabinet or housing of the cell has been omitted for, sake of clarity. The cell is constructed with a cathode 12 parallel to the separator. Ordinarily, it is formed of screen wire material. It is positioned parallel to and near the separator 10. Indeed, it can be placed in contact with the separator in certain arrangements. It serves to make an electron interchange with ions in solution in the cell to thereby impart a charge to the ions. This triggers operation of the electrolysis cell. The cathode 12 is parallel to a similar wire screen 14 which serves as the anode. The cathode and anode are both formed of screen like members and thereby permit bubbles to pass through them. Moreover, they are submerged in the solution which fills the cell, thereby enabling ions to migrate in solution. A chlor-alkali cell will be described to provide a context for operation of the present procedure.

In ordinary installations, one cell is serially installed with several other cells. The power supply shown with this cell will operate but it is more a tutorial devioe to assist explanation. A DC supply system is connected to the cell. This requires that the anode 14 be connected to a positive voltage source. Such a source is indicated generally at 16, and a negative voltage source is indicated generally at 18. The cell is connected between the two voltages for operation. To illustrate the possible voltage levels available for operation of this device, the positive and negative voltage sources are spanned by resistors 20 and 22 connected in series. Conveniently, they are adjustable resistors. They are adjusted to enable a voltage tap to be placed at a specified voltage level. This is applied through a conductor 24 to a screen electrode 26 as will be described. The conductor 24 thus furnishes a specified voltage. The voltage can be varied through a range. The range preferably spans the voltages applied to the anode and cathode. In other words, if the anode and cathode define a voltage span of about 3 volts, mid point voltages in the 3 volt span are available for the screen electrode 26. However, there are circumstances where the screen voltage for the screen electrode 26 may be outside the range of the voltage across the cell. To this end, resistors are shown connected between the voltage sources and the anode and cathode. This will aid in explanation of operation of the device.

In practical applications, the cell is typically connected in series with several similar cells and a large DC voltage source is connected to the bank of cells. The voltage for the screen is obtained from some available voltage tap in the serially connected cell, thus enabling omission of the voltage sources and resistors shown in FIG. 1 for explanatory purposes. In conclusion, it may be necessary to reference the screen voltage to a particular reference voltage. That is, it may be equal to the voltage placed on the cathode, the anode, some voltage therebetween, or some voltage outside the range defined by the cathode and anode.

The screen 26 is shown in FIG. 2 embedded in the separator 10. Preferably, it extends to the outer dimensions of the separator. It should be kept in mind that the separator must be placed in the cell and is typically clamped or held around the peripheral edge. This is necessary to define the separated chambers in the cell. Even in that instance, the screen 26 is preferably extended entirely to the periphery so that it can be clamped. This avoids leaks past the screen electrode 26 around the edge. Moreover, the separator 10 is preferably formed of a structure sandwiching the screen electrode 26 in the middle. The screen current is nearly zero. It is therefore preferably made of light gauge wire. Indeed, the gage of the wire can be quite light, perhaps 50 gauge or smaller. It is woven with a selected mesh. Moreover, it is coated with an insulating material. It is insulated to avoid electrical current flow through it. It is also coated to provide a chemical resistant surface so that it is not attacked by the strong chemical reactions which are encountered in the electrolysis cell. One suitable mode of manufacture of the screen is to utilize an ion exchange resin membrane of typical construction, one example being a sulfonic acid fluoropolymr. Two such layers are utilized, one being pressed on each side of the screen electrode 26. The two are then bonded to form the sandwich construction shown in FIG. 1. Thus, the screen electrode 26 is electrically insulated from the electrodes 12 and 14. It is also insulated from current flow through it so that it provides a static field but not a flowing current. If the screen is made of a material which is not susceptible to direct chemical corrosion, it is possible to utilize a different type screen. For instance, the cathode might be a low hydrogen overpotential member such as platinum. The screen 26 can then be made a high hydrogen overpotential screen formed of nickel or titanium. In this instance, with a high hydrogen overpotential difference, the errant ion will not react of become reduced at the screen.

Consider one example of operation. FIG. 1 shows a stray $OH^-$ ion 30. It is forced by electrostatic repulsion away from the separator 10. This prevents the ion 30 from random migration in the reverse direction through the separator. Thus, the $OH^-$ ion population in the immediate vicinity of the cathode 12 might be quite high. The ion is nevertheless forced away from the separator 10 to thereby suppress unwanted ion migration through the separator. This enables the separator 10 to thereby receive the $Na^+$ migration from the anode to the cathode side to form caustic of high strength with great efficiency. This reinforces the exchange membrane operation.

Attention is now directed to FIG. 3 of the drawings. An alternate form of construction of the separator is shown at 36. The separator 36 is formed of a conventional separator layer 38. As an example, it can be an ion exchange resin membrane. On one face, a connective tab 40 is located. In that area or on that face, a conductive layer is formed. This has the preferred form of particulate material, ideally with a high hydrogen overpotential such as nickel or titanium. It is applied in particulate form. Another layer is identified at 42. It is preferably an additional separator layer meaning that it is made of the same material as the layer 38. They can be equal in thickness but there is no gain in requiring this. In fact, it might be to advantage to place the layer of particulate material near the cathode face of the separator 36. This off center placement has the advantage of creating a repellent field that extends into the catholyte solution contacting the separator 36. One example of the layer 42 is an ion exchange resin membrane overlaid on the particulate material. One advantage of the arrangement shown in FIG. 3 is that the layer 46 is made of particulate material randomly distributed with a suitable binding agent. It can be constructed by deposition onto the surface of the layer 38. A suitable binding agent can be used to secure the layer 46.

As will be understood, the separators 10 and 36 have been greatly exaggerated in thickness. Ordinarily, it is desirable that they be relatively thin to reduce their resistance to current flow through the cell. On the other side of the coin, they are preferably thick so that ionic separation is achieved to a high level. Also, there is a requirement that they be reasonably thick to be sufficiently rugged. Thus, a balance can be achieved by the addition of the electrified layer in the separator. That is, the thickness and the tortuosity of the path through the separator can both be optimized by the incorporation of the electrified layer.

In operation, the voltage applied to the electrified screen electrode can vary widely depending on circumstances. It may be sufficient simply to make that layer somewhat more negative than the cathode. On the other hand, it may be appropriate to tie this layer to the cathode. Adjustments might be made depending on the physical parameters of the separator as well as the requirements of the electrolysis process undertaken in the cell.

In the event that a wire screen is used, the mesh of the screen can be varied widely. Moreover, the other physical dimensions of the screen can also be varied depending on requirements. Indeed, the wire gauge can be reduced to the smallest permissible wire gauge for the screen to permit its use with the separator under ordinary circumstances of installation.

While the foregoing is directed to the preferred embodiment, the scope thereof is determined by the claims which follow.

What is claimed is:

1. A method of operating a galvanic or electrolytic cell involving ionic movement where the cell has a central separator spanning the cell and permitting controlled ionic movement, the cell further having spaced anode and cathode electrodes on opposite sides of the separator, the method of operation comprising the steps of:

(a) applying DC voltage to anode and cathode electrodes of the cell having an aqueous solution of salt dissolved therein to form OH ions in the vicinity of the cathode while also forming metal ions in the vicinity of the anode;

(b) selectively transferring a species of ions across the separator in response to electrical attraction acting on the transferred ions wherein the attraction assists in ionic transfer and wherein transfer is accompanied by an unwanted transfer of a second species of ions across said separator;

(c) positioning a screen electrode with the separator wherein said screen is formed by embedding particulate conductive material in said separator and forming a conductive pathway through said particulate material; and (d) applying a selected bias voltage to the screen, the bias voltage being independent of the DC voltage between the electrodes, to form a voltage bias repelling the second species of ions from transfer through the separator while permitting the first species of ions to pass through.

2. The method of claim 1 wherein the screen electrode is a nonelectrocatalytic material.

3. The method of claim 1 wherein the material is nickel or titanium.

4. The method of claim 1 wherein the screen electrode repels OH and chloride ions from passing through the screen electrode in a chlor-alkali cell.

5. The method of claim 4 wherein the screen electrode is located in the separator and electrically acts on the OH and chloride ions to prevent entry into said separator.

6. The method of claim 1 wherein said screen comprises a wire screen parallel to the separator.

7. The method of claim 6 wherein said wire screen has openings in the mesh to permit flow therethrough, and including the step of insulating the mesh thereof.

8. The method of claim 1 including placing an external conductor from said previous layer connected with a voltage source and wherein the voltage source is negative compared with the voltage source of the cathode in the electrolysis cell.

9. The method of claim 1 wherein said particulate material layer includes an electrically conducting polymer.

10. The method of claim 1 wherein said particulate material layer is buried in an ion selective membrane.

11. The method of claim 1 wherein said particulate material layer is coextensive with said selective membrane.

12. The method of claim 1 including the step of connecting the screen electrode to an independent and variable voltage source and adjusting screen electrode voltage to a desired voltage.

* * * * *